United States Patent [19]

Huettemann

[11] Patent Number: 4,942,707

[45] **Date of Patent: * Jul. 24, 1990**

[54] LOAD-BEARING ROOF OR CEILING ASSEMBLY MADE UP OF INSULATED CONCRETE PANELS

[76] Inventor: Erik W. Huettemann, 285 Mill Rd., Madison, Ala. 35758

[ * ] Notice: The portion of the term of this patent subsequent to Jun. 27, 2006 has been disclaimed.

[21] Appl. No.: 371,915

[22] Filed: Jun. 27, 1989

Related U.S. Application Data

[63] Continuation-in-part of Ser. No. 158,476, Feb. 22, 1988, Pat. No. 4,841,702.

[51] Int. Cl.[5] ..... E04B 1/60

[52] U.S. Cl. ..... 52/259; 52/309.12; 52/612; 52/602; 52/745; 264/32; 264/45.1

[58] Field of Search ..... 52/309.12, 809, 583, 52/81, 612, 745, 602, 259; 264/32, 45.1, 267, 271.1

[56] References Cited

U.S. PATENT DOCUMENTS

| | | | |
|---|---|---|---|
| 3,232,017 | 2/1966 | Prusinski et al. | 52/809 X |
| 3,382,637 | 5/1968 | Longinotti | 52/309.12 |
| 4,075,805 | 2/1978 | Bongiovanni | 52/309.12 |
| 4,090,336 | 5/1978 | Carroll | 52/309.12 |
| 4,512,126 | 4/1985 | Walston | 52/309.12 |
| 4,625,472 | 12/1986 | Busick | 52/309.12 |
| 4,625,484 | 12/1986 | Oboler | 52/309.12 |
| 4,674,242 | 6/1987 | Oboler et al. | 52/309.12 |
| 4,680,901 | 7/1987 | Armitage | 52/81 |

*Primary Examiner*—James L. Ridgill, Jr.
*Attorney, Agent, or Firm*—Joseph H. Beumer

[57] ABSTRACT

A three-layer insulated concrete panel includes as the middle layer an insulating slab having grooves which provide a form for casting of concrete supporting ribs integral with a layer of concrete cast over the grooved face. A layer of material, such as particle board, is bonded to the ungrooved face of the slab. In preparing the panel, the slab is placed on a flat surface with the particle board face down. Forms are then placed in spaced-apart relation to panel edges, and concrete is cast into the forms and grooves and over the grooved panel face. The insulating slab provides a form for casting of supporting ribs and is permanently retained in the panel, giving it a high insulating value. An assembly of such panels in a roof or ceiling structure is disclosed wherein individual panels are placed in final position, and joints between adjacent panel edges are obtained by covering exposed strips along adjacent panel edges with a cap member and applying concrete over the cap member.

12 Claims, 5 Drawing Sheets

LOAD-BEARING ROOF OR CEILING ASSEMBLY MADE UP OF INSULATED CONCRETE PANELS

CROSS REFERENCE OF RELATED APPLICATION

This application is a continuation-in-part of application Ser. No. 158,476, filed Feb. 22, 1988, now U.S. Pat. No. 4,841,702.

TECHNICAL FIELD

This invention relates generally to building panels and more particularly to prefabricated concrete building panels.

BACKGROUND OF THE INVENTION

Precast concrete panels are being used for a variety of application in building construction owing to savings obtained reductions in construction time and forming requirements. Precast panels are normally prepared by casting them in suitable molds on a horizontal surface, which may be an already cast floor slab at the construction site. Upon curing, the panels are placed in vertical position by means of a crane using "tilt-up" construction techniques and are bolted in place. One type of panel which has gained widespread acceptance a waffle-shaped panel in which weight savings are obtained, consistent with high strength, by providing a network of intersecting reinforced ribs projecting outward from one face of the panel. The ribs are integrally with the remainder of the panel using a special mold. Typically, a panel having the strength of an eight-inch structural section may be obtained using the equivalent of only three and one-half inches of concrete.

Various disadvantages and limitations are exhibited by existing waffle-shaped panels. The as-cast panels are not insulated, and if insulation is to be provided, it must be installed later, typically by inserting fiberglass batts into the voids between ribs and enclosing the batts by attaching an insulating foam board to the rib ends. Other measures such as attaching a foam board on the flat panel face with an adhesive or nailing furring strips to the panel rib ends with concrete nails have also been used. Such measures are labor-intensive and add substantially to costs. In addition, the existing panels have been limited in their application for use as ceiling panels owing to their inability to meet strength requirements for long overhead spans.

SUMMARY OF THE INVENTION

The present invention is directed to ceiling or roof structures made up of an assembly of building panels having a self-supporting, rigid insulating slab provided with a plurality of grooves or channels located in one face of the slab and having concrete cast over that slab face, forming supporting ribs in the grooves and a layer disposed over the face. The insulating slab serves a dual purpose in that it acts as a mold for the concrete during casting, and it is permanently retained in the finished panel as highly effective insulation, filling the voids between panel ribs and providing a layer that covers the rib ends. The face of the slab opposite the concrete layer preferably has a flat sheet of interior wall material secured thereto, thus providing a three-layered structure which, when installed as a wall section, includes an outer layer of concrete, a middle layer of insulation with supporting concrete ribs extending partially through the insulation, and an interior layer that protects the insulation and provides a surface suitable for application of any desired interior finish. By providing increased thickness of the insulating slab, panels embodying the invention may be made stronger for use as overhead ceilings and upper-story floors. These panels are characterized by their relatively light weight and their insulating and load-bearing capabilities. In addition, fabrication expenses are minimized, owing to avoidance of any need for expensive forms or other special casting equipment.

In an embodiment for load-bearing ceilings or roofs, an assembly of panels is provided, with the individual panels having edge frames precast integral with the outer layer of concrete for panel edges that form a part of the outer edge of the roof or ceiling when assembled. Panel edges at interior locations where panels are placed side by side do not have an edge frame, and the outer concrete layer is recessed away from the edge, leaving an exposed strip of insulating material. After the panels are placed in position on the roof or ceiling, a cap member is disposed over the exposed strip, covering the juncture between adjacent panels. Concrete is then cast, filling the recessed gap and providing a leak-proof seal.

It is therefore an object of the present invention to provide concrete building panels having a layer of structural concrete and a layer of insulation integrally formed therewith.

Another object is to provide a building panel having lightweight, high strength and a high insulating value.

Still another object is to provide high-strength insulated concrete panels usable for ceilings as well as walls.

Another object is to provide waffle-shaped concrete panels that are insulated as-cast.

Yet another object is to provide a method of preparing concrete building panels wherein the need for use of specialized forms is avoided.

Another object is to provide a method of preparing insulated concrete panels wherein the insulation itself serves as a form for retaining cast concrete.

DESCRIPTION OF THE PREFERRED EMBODIMENT

Figure 1:
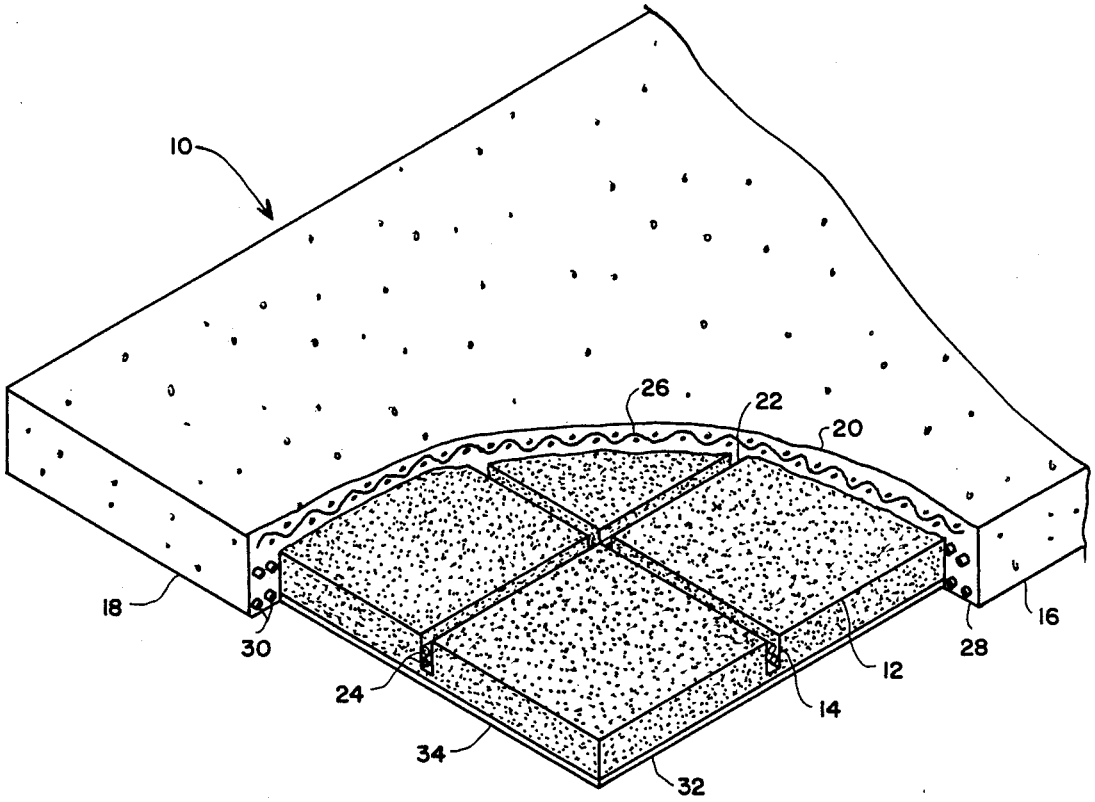
FIG. 1 is a pictorial view, partially broken away, showing a building panel embodying the invention.

Referring to FIG. 1 of the drawings, a three-layer building panel 10 is shown. The middle layer 12 of the panel is a rigid slab of insulating material such as foam polystyrene having a density of one to two pounds per cubic foot. Grooves 14 of rectangular cross section are disposed in one face of the slab parallel to side 16 and end 18, the grooves intersecting one another and forming a grid or waffle pattern. A layer 20 of cast concrete is located over the grooved face of the slab with ribs 22 of concrete integral with layer 20 extending into the grooves. Reinforcing bars 24 are positioned within and along the length of the grooves, concrete being cast around the bars in accordance with usual practice. Wire mesh reinforcement 26 is incorporated in concrete layer 20 for additional strength. A concrete edge frame 28 of rectangular cross section encloses the panel edges, forming sides 16 and ends 18. Edge frame 28 also has reinforcing bars 30 incorporated therein along the length of the flange. The edge frame, like the reinforcing ribs, is cast integrally with layer 20. Face 32 of the slab opposite the grooved face has bonded thereto a layer 34 of nailable material such as wooden particle board or plywood sheet.

Figure 2:
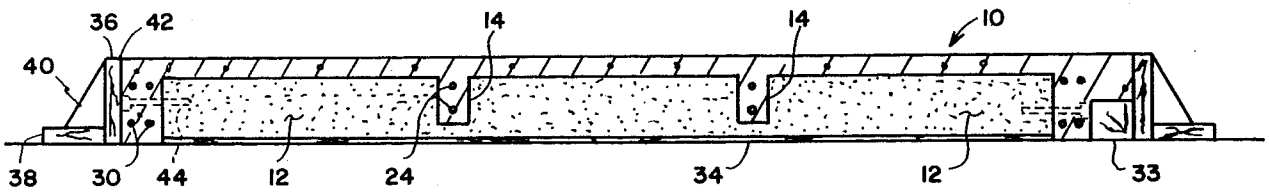
FIG. 2 is a cut-away view of a cast panel, with edge forms in place.

FIG. 2 shows a panel 10 in as-cast condition prior to separation from forms around its edges. Necessary steps and procedures for preparation of the panel are explained herein with reference to this figure. The panel shown has an overall thickness of eight inches. In preparing the panel, a six-inch thick slab or block 12 of foam polystyrene is first adhesively bonded to a ⅜-inch thick sheet 34 of wood particle board. Grooves 14 are then cut into the opposite face of the insulating slab by means such as routing. For the panel shown, the grooves are one and a half inches thick and five inches deep and have uniform depth and a rectangular cross section. The grooved slab is then placed on a flat horizontal surface with the particle board face down, and forms are positioned around the panel edges. The forms as shown include a board 36 placed on its edge and secured to another board 38 placed flat on the casting floor, with braces 40 being provided as required. Upper edge 42 of board 36 controls the thickness of concrete layer 20; thus, the width of board 36 is selected to provide the desired layer thickness. For the panel shown, a thickness of 1⅝ inches is obtained. In general, a thickness of ½ to 3 inches may be used. The form boards are, of course, placed level and at a selected distance away from edges of the insulating slab. Form boards at the panel end shown at the left side of the drawing are separated a distance of four inches from that panel end and thus provide a concrete edge frame thickness of four inches. At the right side of the drawing, the form boards are spaced eight inches from the panel edge, and a 4×4 timber insert 33 is provided along the length of the form adjacent to the bottom of the form. This results in a 4×4 notch along the bottom of the panel edge, which facilitates assembly of finished panels as will be explained below. Spacers 44 are disposed to maintain separation between the form boards and the slab. Two reinforcing bars 24 are placed in each groove one above the other and are supported by means of conventional spacers (not shown). Four reinforcing bars 30 are also located between forms and edges of the slab and are supported by spacers.

Concrete is then poured into the assembled forms, filling the grooves and edge regions and providing a layer over the top face of the slab. The upper surface is worked using conventional techniques to provide a flat finished surface. Upon curing, the edge forms are removed and a finished panel is obtained.

Figure 3:
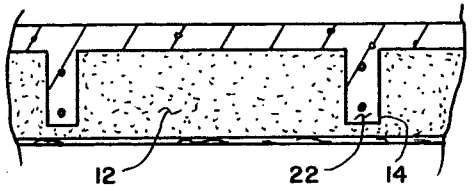
FIG. 3 is a sectional view of an embodiment of the invention wherein a thicker slab of insulation is employed.

FIG. 3 shows an embodiment of the invention wherein the panel is made thicker to provide greater strength for applications such as long-span ceiling panels. This panel is essentially the same as the panel as described with respect to FIGS. 1 and 2 except that the insulating slab 12 is two inches thicker and the grooves 14 are cut two inches deeper to provide wider ribs 22. Also, the edge frame is correspondingly wider.

Figure 5:
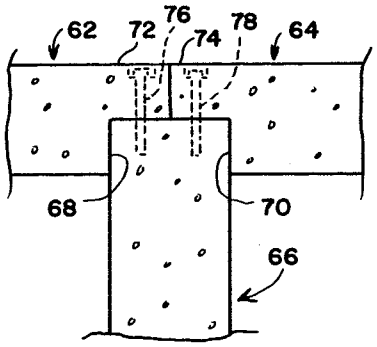
FIGS. 4, 5, and 6 are cut-away planar views showing how the separate panels may be joined together in construction of a building.
Figure 4:
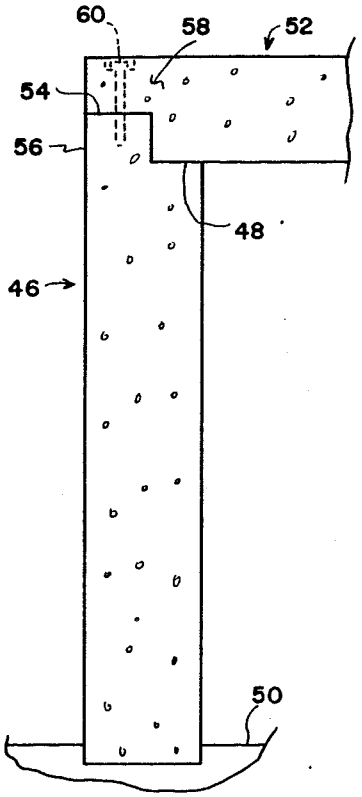

FIGS. 4 and 5 show methods of assembling panels into building structures using rabbetted joints formed by overlapping of panel edges having notched-out corners formed in the casting process as described above for the panel end shown at the right side of FIG. 2. In FIG. 4, panel 46 is shown erected in vertical position on footing 50. The top, inside end of the wall panel has a corner notch 48 extending along the width of the panel end, the notch thickness being one-half the panel thickness. The outside end of the panel has a projecting shoulder 56 extending across the panel end and corresponding in size to notch 48. Ceiling panel 52 at the bottom side of its left-hand end also has a notch 54 extending across the panel end and a projecting shoulder 58 at the top side of the panel end and corresponding in size to notch 54. The two panels are shown assembled with shoulders partially overlapped to form a rabbetted joint. The panels are secured together by bolts or screws 60 extending through shoulder 58 and into shoulder 56.

FIG. 5 shows an assembly for joining ceiling panels 62 and 64 to a load-bearing internal wall panel 66. Panels 62 and 64 have notches 68 and 70 and projecting shoulders 72 and 74 as described above for panel 52 of FIG. 4. The assembled panels are secured together by bolts 76 extending through panel 62 and bolts or screws 78 extending through panel 74, both sets of bolts or screws being anchored in the upper end of panel 66.

Figure 6:
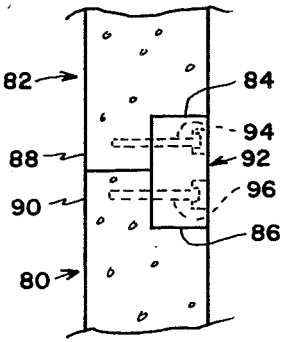

FIG. 6 shows an assembly of wall panels in edge-to-edge relationship. Panel 80 has a notch 86 and projecting shoulder 90 extending across its end, and panel 82 has a notch 84 and shoulder 88 across its end. In this assembly, shoulders 88 and 90 are placed in contact with one another, leaving a gap on the other face of the panels defined by notches 84 and 86. A separate member 92 having a cross section defined by the gaps and extending the length of the joint is disposed in the gap and secured to panels 80 and 82 by bolts or screws 94 and 96, respectively. The separate member may be solid cast concrete or concrete cast around an insulating slab. Individual panels for a specific application may be prepared to have notches and shoulders in appropriate locations by including or omitting inserts 33 in the casting forms as shown at the right side of FIG. 2.

Figure 7:
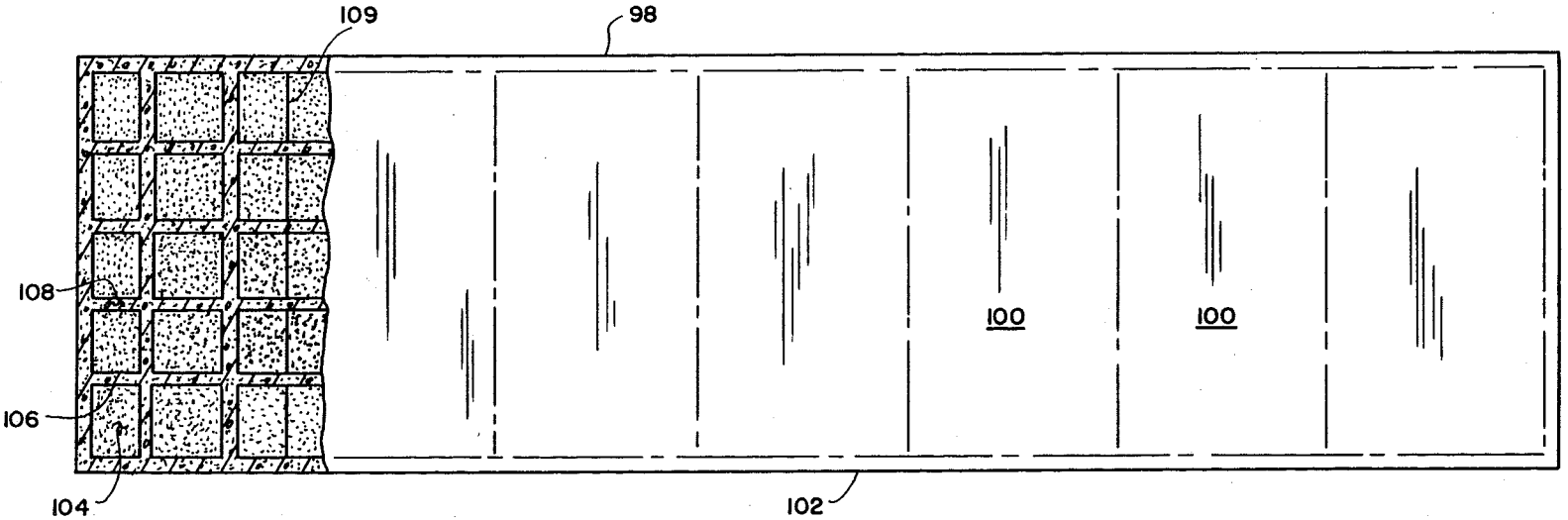
FIG. 7 is a planar view of an elongated panel made up of multiple individual units.
Figure 8:
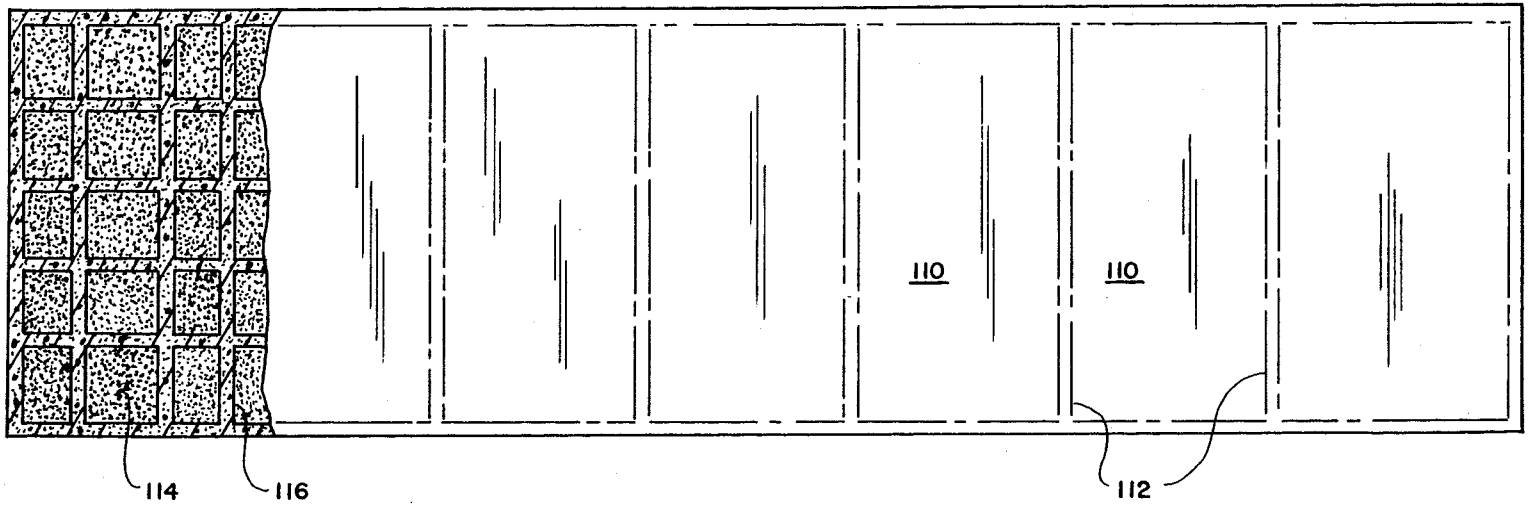
FIG. 8 is a planar view of an elongated panel made up of individual units and having concrete frame members between the units.

FIGS. 7 and 8 show embodiments of the invention wherein an elongated panel structure is made up to include multiple individual units, in each case seven, in an integral cast structure. In FIG. 7, elongated panel 98 generally includes the equivalent of seven panels as described above with reference to FIGS. 1 and 2, except that the individual units 100 are disposed with their longer sides adjacent one another within a cast outer frame 102. In preparing elongated panels according to this embodiment, individual insulating slabs 104 having an intersecting network of grooves 106 in one face and particle board (not shown) bonded to the opposite face would be placed to form a rectangular array with the particle boards face down on a flat surface and with the longer sides of adjacent slabs having their edges in contact. Forms would then be placed around the outer edges of the array and reinforcing bars and mesh inserted in the same manner as for preparing the individual panels units as described above. Individual panel units in the elongated panel would be held in place by reinforcing ribs 108 that extend across the interface 109 between adjacent panel units. The outer frame, ribs, and concrete layer would be cast integrally in the same manner as described above.

FIG. 8 shows an embodiment similar to FIG. 7 except that individual panels units 110 are spaced apart, and transversely extending concrete frame members 112 are provided in the spaces between individual units. In preparing elongated panels according to this embodiment, the grooved insulating slabs 114 having particle boards 115 bonded to the ungrooved face are placed particle board face down and spaced apart a distance corresponding to the desired thickness of vertical frame members. Edges 116 of individual slabs serve as forms for casting of the concrete vertical frame members. The frame members between slabs, like the ribs and outer frames, are formed integral with the rest of the concrete portion of the panel. The transverse frame members between the individual units provide increased support and enable use of the elongated panels for high-strength applications.

Figure 9:
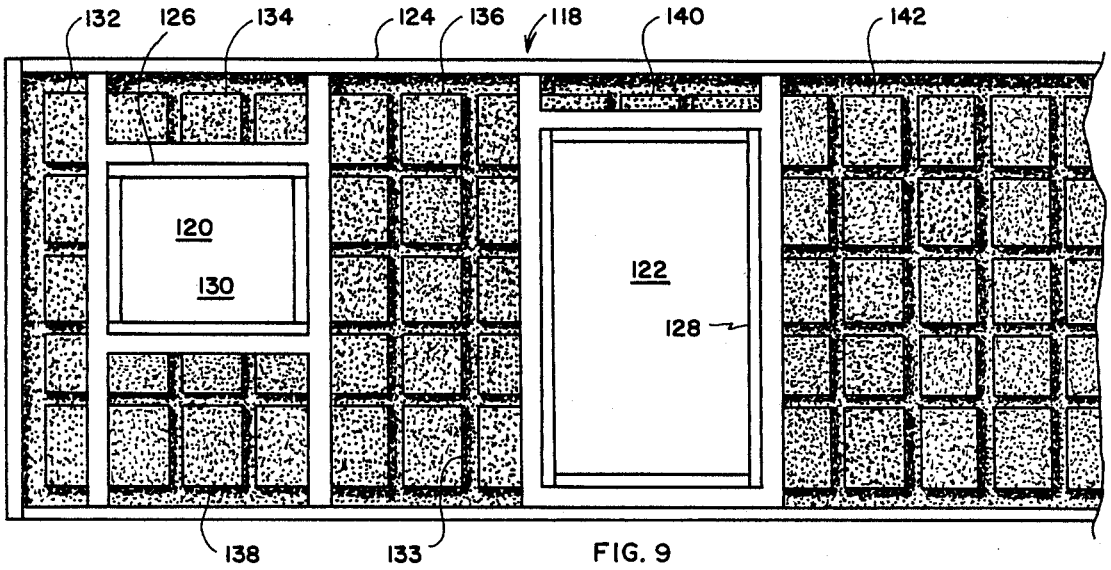
FIG. 9 is a planar view showing the preparation a of panel wherein block-out forms are used to produce openings for doors and windows.

In FIG. 9, an elongated panel 118 is shown in an embodiment wherein openings 120 and 122 are provided for a window and door, respectively. The panel assembly is shown in condition for casting with edge forms 124 being spaced apart from panel edges and block-out forms 126 and 128 spaced apart from insulating slab edges at the window and door openings. In preparing this panel, a particle board 130 is laid down, and pieces 132, 134, 136, 138, and 140 of insulating slab, having grooves 133, are cut to form the desired pattern around the openings and are then bonded to the particle board. Reinforcement is placed in position, and concrete is then cast into the grooves and frame forms and over the exposed slab faces, providing an integral cast layer, ribs, and edge frames around the window and door. Upon curing, the particle board across the openings is then cut away. Openings as required for utilities or other purposes can also be obtained by providing suitably sized block-out forms. Inserts for lifting and positioning the panels should also be placed in the form prior to casting.

Numerous variations in dimensions and materials for the various layers may be employed within the scope of this invention. In general, overall panel size may be varied from 4 by 8 feet to 24 by 40 feet. As described above with respect to FIGS. 7 and 8, larger, elongated panel units may be made by placement of individual units side by side within a single outer frame. The grooves in the insulating slab, and the ribs formed therein, are preferably arranged in an intersecting network or waffle pattern, forming uniform squares with sides in the range of one to two and one-half feet long. Depth and width of the grooves and thus the width and thickness of the ribs cast therein may be varied depending upon strength and insulation requirements. In general, a groove depth is selected such as to leave at least one inch of the slab intact, with the remaining thickness of insulation being sufficient to avoid the presence of thermal bridges at the embedded edges of the ribs.

The insulating slab must be rigid and strong enough to allow cutting of grooves and to maintain its shape during casting of concrete. Foamed polystyrene having a density of one to two pounds per cubic foot is suitable for this purpose. Other type of foam materials which meet the above-stated requirements may also be used. A foam slab thickness of 4 to 24 inches may be used, depending on the application, with thicker slabs providing greater strength and a higher insulating value.

The material used for the layer on the face opposite the concrete layer may also be varied, depending on the particular application. In most cases, a nailable, wood-based sheet material such as particle board, plywood, wafer board, or masonite, is preferred to facilitate interior finishing and to provide a base for ready application of sheet rock by nailing. Fiberglass sheet material may also be used. The sheet material is preferably bonded to a face of the insulating slab by means of a suitable adhesive as the first step in making the panels. A sheet material thickness of $\frac{3}{8}$ to 1 inch is preferred, with greater thicknesses being used where the sheet is intended to support heavy items such as wall cabinets, shelves, or the like. Additional layers of material may be added to the panel if desired.

Composition of the concrete used in the panel is not limited to a particular mixture, and conventional structural concrete mixtures may be generally used. As described above, the concrete is shown reinforced with steel reinforcing bars and wire mesh. Other reinforcing means such as plastic bars or reinforcing fibers may also be employed. Conventional techniques may be used in casting the concrete and working the outer surface as required. Any desired surface finish may be obtained by applying suitable materials on the surface or using working techniques to provide a particular texture.

Curing of the cast concrete may be carried out by using conventional methods, with a curing time of 12 hours being preferred. To avoid cracking due to cooling too rapidly, especially in cold weather, insulation may be placed over the exposed concrete face during curing.

By using interior sheet material that has been treated with a fire retardant, the panels may be rendered virtually fireproof, thus providing another important advantage, particularly for ceilings where conventionally used wooden materials allow fires to spread rapidly.

FIGS. 10–13 show an embodiment wherein an assembly 142 of individual panels 144 provides a load-bearing roof or ceiling. The individual panels are elongated in shape and may extend over a long span which may be up to about 40 feet, and particularly at least 32 feet. The panels are made up of two slabs 146 and 147 placed end to end and having longitudinal grooves 148 extending along their entire length, and the grooves have concrete ribs 150 including reinforcing bars 152 cast therein. The bottom face of the slabs preferably have a layer 153 of nailable material such as particle board bonded thereto. Two slabs rather than one are used in each panel because such slabs are normally available only in sixteen-foot lengths, and a longer span is required for the embodiment shown. A concrete layer 154 is cast over the grooved face of the slabs except for an open strip 156 along edges 158 of adjacent panels within the interior of the assembly. Panel edges 160 that are located at exterior edges of the assembly have an edge frame 162 that is cast integrally with the concrete ribs 150 and upper layer 154.

Joints between adjacent panels at interior locations may be provided by assembling the panels in their final position, providing a cap member 164 that covers the juncture between panels, securing the cap to the adjacent exposed strips of the insulating slab and casting concrete to fill the gap 166 between concrete layer edges of the adjacent panels. The cap may take the form of an elongated metal member having a U-shaped cross section and a pair of sides 166 and 168 that may be driven into the slabs until its top is flush with the slab surfaces. The cap and concrete cast over it provide a leak-proof joint. Joints between adjacent edge frames at the ends of the assembled panels may be sealed by means such as caulking or by providing recesses in the top surfaces of the edge frames at the joint location to produce a gap, which may be filled with concrete in the same manner as for the gap over the open strips of the insulating slabs.

Figure 11:
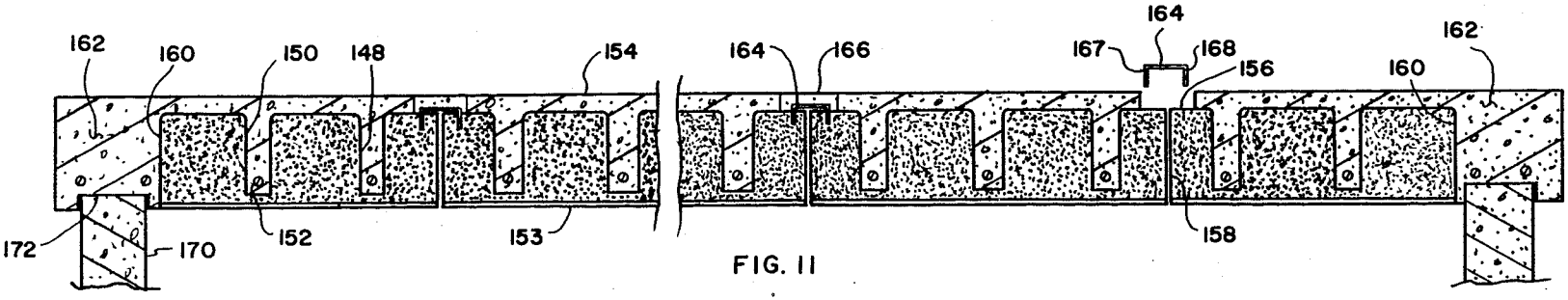
FIG. 11 is a sectional view taken along line 11—11 of FIG. 10 showing details of the joint between panels.
Figure 10:
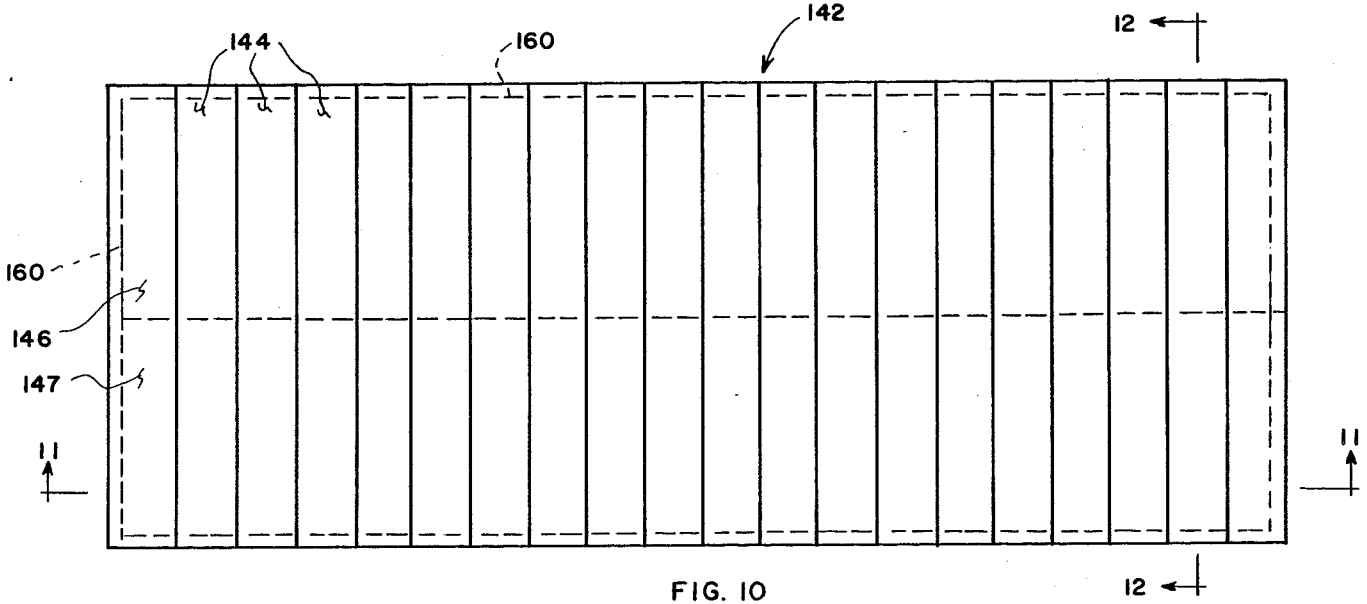
FIG. 10 is a planar view of an assembly of panels joined together and forming a load-bearing roof.
Figure 12:
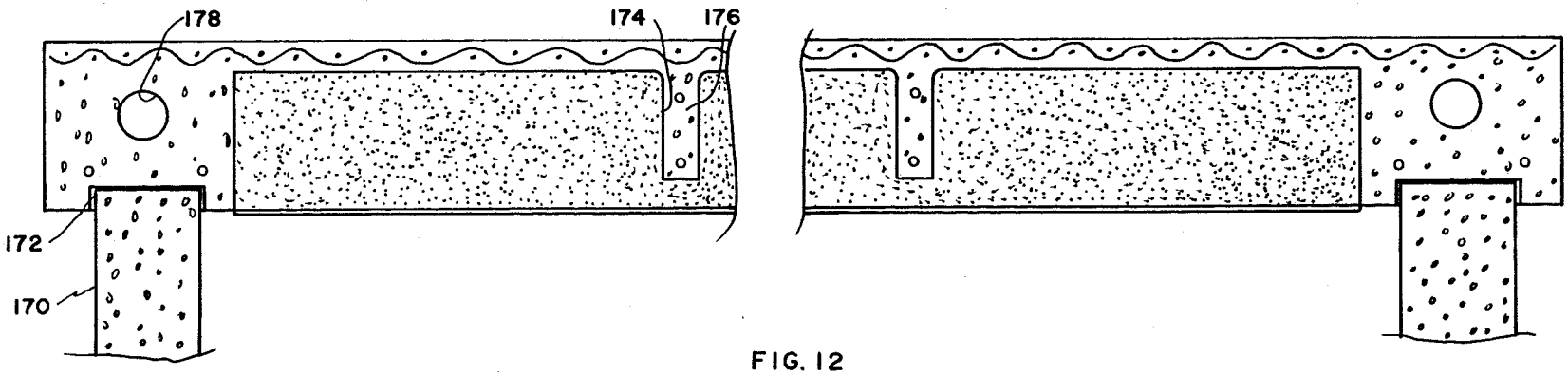
FIG. 12 is a sectional view taken along line 12—12 of FIG. 10.

As shown in FIG. 11, the assembly is supported by load-bearing edge frames 162 that are disposed to fit onto walls 170, with notches 172 being provided in the bottom of the edge frames for this purpose. FIG. 12 shows additional structure features that may be incorporated in the panel and panel assembly. Transversely extending grooves 174 with ribs 176 cast therein are included for additional strength in the panels. In the embodiment shown, each sixteen-foot slab, two of which are placed end to end in each panel, would preferably include grooves for two transverse ribs. Edge frames at the panel ends may include a transversely extending channel 178, enabling insertion of a rod or bar therethrough along the length of the assembly. The rod or bar would be tightened up after assembly to provide post-stressed reinforcement.

Figure 13:
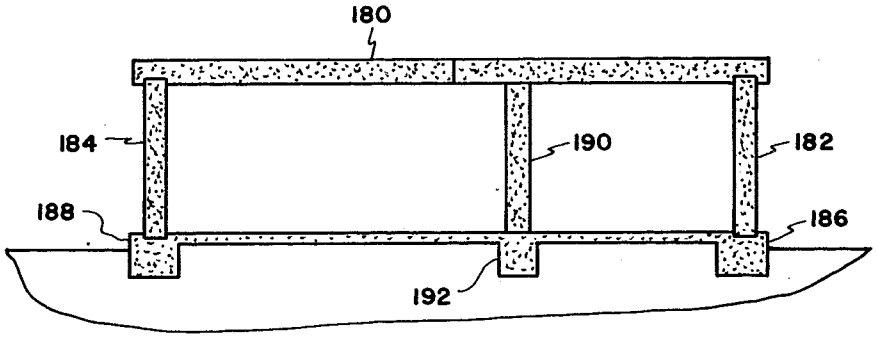
FIG. 13 is a sectional view of an assembled roof and supporting structure of a building.

FIG. 13 shows a panel assembly 180 in place over supporting exterior walls 182 and 184, which in turn are supported by footings 186 and 188. In this embodiment, additional support is provided by an interior wall 190 coupled to footing 192. At the juncture between the panel assembly 180 and interior wall 190 load-bearing capability may be provided by notching out the panel bottoms, removing particle board and insulation up to the level of the bottom of the ribs. The wall in contact with the ribs provides effective support for the assembly. Maximum support may be obtained by locating the wall directly under a supporting transverse rib as well as under a longitudinal rib. This embodiment is useful for applications wherein the desired length of the panels exceeds a panel length that may be supported only by the panels ends.

The embodiment of FIGS. 10–13 has particular application to commercial buildings of substantial size and having a relatively long width to be spanned. Forming the individual panels on the floor and lifting them up for assembly enables use of a smaller crane than would be required for lifting the entire assembly if prepared as a single unit. For use as a roof, the panel assembly as described above may be provided with a pitch such as 1/150 slope to facilitate run off of water.

I claim:

1. A load-bearing roof or ceiling assembly comprising:

a plurality of elongated, rectangular panels disposed side by side, forming an array having interior junctures between adjacent panels and external panel edges at edges of the array;

said panels comprising at least one rigid rectangular slab of insulating material having an upper face and a lower face, said upper face having a plurality of longitudinally extending grooves therein, forming channels for containing supporting ribs, concrete cast into said grooves and over said upper face providing concrete ribs and a concrete layer over said face;

said panels at external edges of the array including cast concrete edge frames integral with said ribs and concrete layer; and said panels at their interior junctures with one another having exposed panel edges without edge frames, said panel edges at interior junctures being sealably joined to one another after placement of panels in operative position in the array.

2. A load-bearing roof or ceiling assembly as defined in claim 1 wherein said panels, prior to forming the array, have an edge structure at interior juncture locations lacking a concrete edge frame and including along the length of the edge a recess in the concrete layer defining a strip of exposed insulation on each of the adjoining panels adjacent the juncture and wherein, after placement in position in the array, the array includes panel joints at interior juncture locations comprising a cap member disposed over said juncture and concrete cast over said cap member filling said recesses.

3. A load-bearing roof or ceiling assembly as defined in claim 2 wherein said cap member is an elongated metal part having a U-shaped cross section and adapted to have its sides driven into insulating material on each side of the juncture.

4. A load-bearing roof or ceiling assembly as defined in claim 3 including an aperture formed in edge frames at panel ends providing access for insertion across the panel array of post-stressed reinforcement means.

5. A load-bearing roof or ceiling assembly as defined in claim 4 including in each of said panels a plurality of transversely extending grooves in said slabs, said grooves containing concrete ribs therein.

6. A load-bearing roof or ceiling assembly as defined in claim 5 including a layer of nailable material secured to bottom faces of said slabs.

7. A load-bearing roof or ceiling assembly as defined in claim 6 including notches in the bottom surfaces of said edge frames for mating with supporting walls.

8. A load-bearing building panel for formation into an array together with other such panels comprising:

an elongated rectangular slab of insulating material made up of at least one piece and having an upper face and a lower face;

said upper face having defined therein a plurality of longitudinally extending grooves for containing supporting ribs;

concrete integrally cast into said grooves, over said upper face and outside and in contact with at least two panel edges, forming supporting ribs, a concrete upper layer and at least two concrete edge frames; and at least one panel edge having no edge frame and the concrete layer adjacent such edge being recessed away edge providing an exposed strip of insulating material along that edge.

9. A long-bearing building panel as defined in claim 8 including a layer of nailable material bonded to the bottom face of said slab.

10. A load-bearing building panel as defined in claim 9 wherein said panel has concrete edge frames only at its shorter edges.

11. A load-bearing building panel as defined in claim 9 wherein said panel has concrete edge frames along both of its shorter edges and along one of its longer edges.

12. The method of constructing a load-bearing roof or ceiling which comprises:

forming elongated panels having a rigid slab of insulating material with a plurality of longitudinally extending grooves in its upper face containing concrete supporting ribs, a layer of concrete covering said upper face except for an exposed strip adjacent to panel edges for interior juncture locations, and concrete edge frames adjacent to panel edges at exterior edge locations of said roof or ceiling;

placing said panels in position to obtain an array with the panels side by side and covering the interior junctures between panels with caps; and casting concrete over said caps so as to cover said exposed strips, thereby providing leak-proof joints between panels.

* * * * *